US010129630B2

(12) United States Patent
Kelley et al.

(10) Patent No.: US 10,129,630 B2
(45) Date of Patent: Nov. 13, 2018

(54) FLOATING-CUP PIVOT FOR HEAD-WORN AUDIO DEVICES

(71) Applicant: Plantronics, Inc., Santa Cruz, CA (US)

(72) Inventors: John A Kelley, Santa Cruz, CA (US); Nicholas W Paterson, Santa Cruz, CA (US); Stann N Sheperd, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 15/458,864

(22) Filed: Mar. 14, 2017

(65) Prior Publication Data

US 2018/0270556 A1 Sep. 20, 2018

(51) Int. Cl.
*H04R 1/10* (2006.01)

(52) U.S. Cl.
CPC ..... *H04R 1/105* (2013.01); *H04R 1/1008* (2013.01); *H04R 1/1066* (2013.01)

(58) Field of Classification Search
CPC ... H04R 1/1008; H04R 1/1066; H04R 5/0335
USPC ..... 381/374, 380
See application file for complete search history.

(56) References Cited

U.S. PATENT DOCUMENTS

2013/0083955 A1* 4/2013 Miyazawa ..... H04R 1/1066 381/378
2013/0272560 A1* 10/2013 Dougherty ..... H04R 1/1066 381/378
2015/0086059 A1* 3/2015 Gougherty ..... H04R 1/1066 381/378
2015/0222980 A1* 8/2015 Pizzaro ..... H04R 1/1058 381/371
2017/0094400 A1* 3/2017 Willman ..... H04R 1/1008

OTHER PUBLICATIONS

Unknown, "Skullcandy Roc Nation Aviator," Apr. 29, 2011, found at URL <http://www.pcmag.com/article2/0,2817,2384277,00.asp>.
Unknown, "Skullcandy Grind Wireless," Feb. 25, 2016, found at URL <http://www.pcmag.com/article2/0,2817,2498953,00.asp>.
Ryan Waniata, "AIAIAI TMA-1 Studio by Young Guru," Aug. 20, 2013, found at URL <http://www.digitaltrends.com/headphone-reviews/aiaia-tma-1-studio-by-young-guru-review/>.
Unknown, "Urban Ears Zinken DJ Style Headphones Review," Jul. 16, 2012, found at URL <http://www.djvibe.com/content/2012/07/urban-ears-first-dj-style-headphones-zinken/>.
Supplementary Information related to citation C4, Images of deconstructed Urbanears Zinken ear cup showing pivoting mechanism and Urbanears Zinken headset as-sold, 2 pages.

* cited by examiner

*Primary Examiner* — Matthew Eason
*Assistant Examiner* — Julie X Dang
(74) *Attorney, Agent, or Firm* — Jeremy S. DesRosier

(57) ABSTRACT

The invention relates to a floating-cup pivot for a head-worn audio device. The head-worn audio device includes an earcup defining an inner cavity. A wall of the earcup includes an aperture. Also, the head-worn audio device includes a pivot within the inner cavity of the earcup. The pivot defines a rotational axis. Further, the head-worn audio device includes an arm having a first end and a second end. The first end of the arm is rotatably attached to the pivot. Still yet, the head-worn audio device includes a stem disposed toward the second end of the arm. The stem is configured to rotate along a path passing through the aperture of the earcup.

18 Claims, 5 Drawing Sheets

FLOATING-CUP PIVOT FOR HEAD-WORN AUDIO DEVICES

FIELD

The present disclosure relates generally to the field of head-worn audio devices. More particularly, the present disclosure relates to an earcup pivot for head-worn audio devices, such as headphones and headsets.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

With the proliferation of smartphones, laptop computers, and tablet devices, users are now able to consume multimedia content anywhere, anytime, and any place. As users increasingly immerse themselves in multimedia content, they turn to head-worn audio devices, such as headphones and headsets, to enhance their multimedia experiences. Designers of head-worn audio devices often need to balance the competing objectives of comfort and durability. For example, while a sturdier pair of headphones may better survive being carelessly tossed into a bag, the increased bulk of such headphones may quickly cramp the neck of a wearing user. One key location of such concern is the interface between the headband and the earcups. In particular, while it is desirable to ensure that the earcups pivot over a wide range relative to the headband (in order to accommodate many different sizes and shapes of heads), such designs often result in large gaps on the earcups, and those gaps permit the passage of debris. Even more, the earcups often house electronic assemblies such as digital-to-analog converters, Bluetooth transceivers, and batteries, and such gaps increase the susceptibility of those assemblies to electrostatic discharge from nearby electrically charged objects.

SUMMARY

In general, in one aspect, the invention relates to a floating-cup pivot for a head-worn audio device. The head-worn audio device includes an earcup defining an inner cavity. A wall of the earcup includes an aperture. Also, the head-worn audio device includes a pivot within the inner cavity of the earcup. The pivot defines a rotational axis. Further, the head-worn audio device includes an arm having a first end and a second end. The first end of the arm is rotatably attached to the pivot. Still yet, the head-worn audio device includes a stem disposed toward the second end of the arm. The stem is configured to rotate along a path passing through the aperture of the earcup.

In general, in one aspect, the invention relates to a floating-cup pivot for a head-worn audio device. The head-worn audio device includes an earcup defining an inner cavity. A wall of the earcup includes an aperture. Also, the head-worn audio device includes a first pivot fixedly mounted within the inner cavity of the earcup, and a second pivot fixedly mounted within the inner cavity of the earcup. The first pivot and the second pivot define a rotational axis. Still yet, the head-worn audio device includes a first arm within the inner cavity of the earcup. The first arm has a first end and a second end. The first end of the first arm is rotatably attached to the first pivot. The head-worn audio device also includes a second arm within the inner cavity of the earcup. The second arm has a third end and a fourth end. The third end of the second arm is rotatably attached to the second pivot. Additionally, the head-worn audio device includes a yoke. The yoke is coupled to the second end of the first arm and the fourth end of the second arm. Moreover, the head-worn audio device includes a stem extending from outside of the earcup and through the aperture of the earcup to the inner cavity of the earcup. The stem is coupled to the yoke and rotates about the rotational axis.

The details of one or more implementations are set forth in the accompanying drawings and the description below. Other features will be apparent from the description and drawings, and from the claims.

DETAILED DESCRIPTION

Figure 1B:
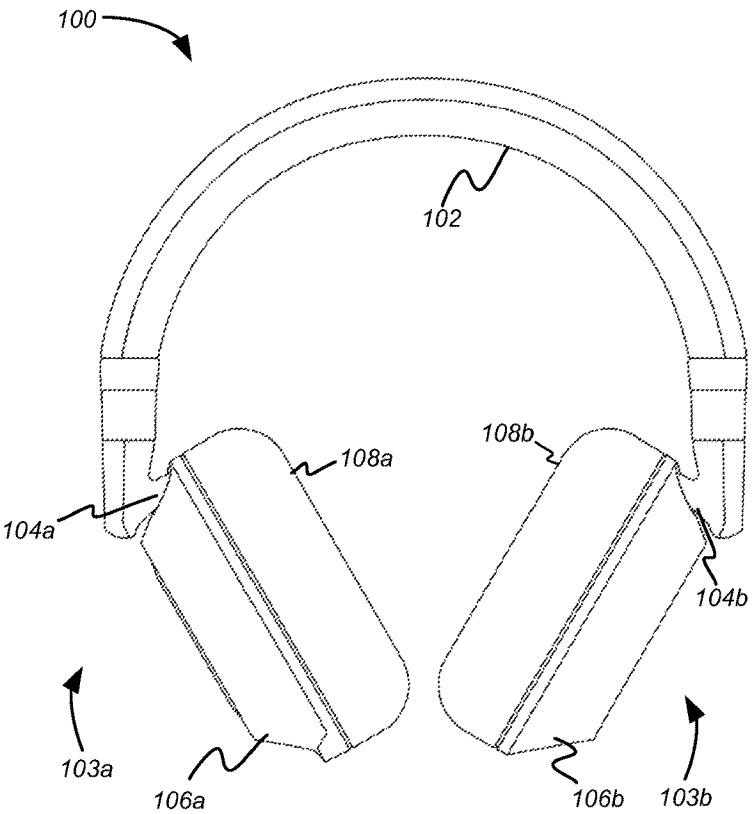
FIGS. 1A and 1B show a head-worn audio device with floating-cup pivots, in accordance with one or more embodiments of the invention.

Specific embodiments of the invention are here described in detail, below. In the following description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following description, any component described with regard to a figure, in the various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment which may be implemented in addition to, in conjunction with, or in place of the embodiments described with regard to a corresponding like-named component in any other figure.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named the elements. For example, a first element is distinct from a second element, and the first element may encompass more than one element and succeed (or precede) the second element in an ordering of elements.

Many head-worn audio devices that have an internal gimbal currently rely on a large earcup aperture through which a protrusion from the headband is able to move dynamically within a plane of the aperture. Although this may provide the earcup with a large range of motion relative to the headband, the gap allows for easy passage of dust, other debris, and electrostatic discharge because the gap is substantially larger than the protrusion. Consequently, additional engineering and materials are required to provide a dust seal that prevents or mitigates the harmful penetration by such elements. Further, during manufacturing, the dust seal necessitates its own assembly steps and quality verification steps. As a result, a headphone manufacturer is presented with the choice of engaging in efforts that increase device costs without improving audio performance, or selling a device that is sensitive to environmental conditions.

In general, embodiments of the invention provide a floating-cup pivot for head-worn audio devices, such as over-the-ear and on-the-ear headphones and headsets. As described herein, the floating-cup pivot enables an earcup to gimbal around one or more swing arms that are hidden on the interior of the earcup while maintaining a static and minimally sized gap. In other words, the floating-cup pivot described herein provides a seamless pivot that enables the earcup to gimbal without opening substantial gaps that would otherwise allow the passage of harmful elements to within the earcup. Accordingly, the floating-cup pivot described herein remains relatively impassible to outside debris without requiring a discrete barrier, such as a dust seal. Additionally, the floating-cup pivot described herein functions properly even within a limited earcup space. Also, the floating-cup pivot described herein provides a head-worn audio device with a differentiated floating appearance that hides and protects the typical, and potentially fragile, mechanical components necessary for articulation of a headphone earcup.

Figure 1A:
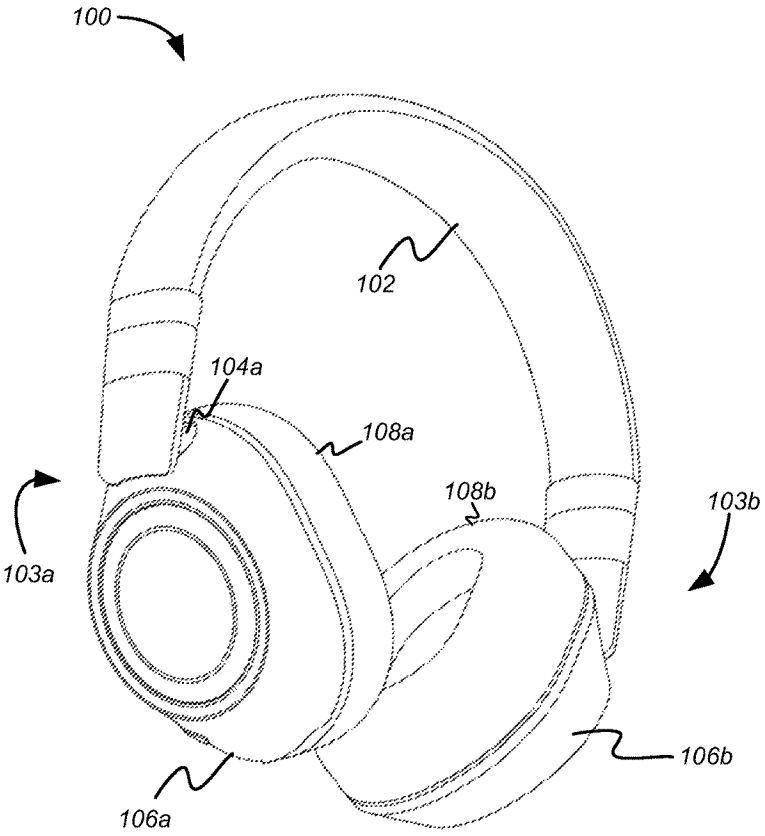

FIG. 1A shows a perspective view and FIG. 1B shows a back view of a head-worn audio device 100 with a floating-cup pivot, according to one or more embodiments. Although the elements of the head-worn audio device 100 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 1A and 1B may be omitted, repeated, and/or substituted. Accordingly, various embodiments may lack one or more of the features shown. For this reason, embodiments of the invention should not be considered limited to the specific arrangements of elements shown in FIGS. 1A and 1B.

As illustrated in FIGS. 1A and 1B, the head-worn audio device 100 includes a headband 102 that interconnects a left ear sub-assembly 103*a* and a right ear sub-assembly 103*b*. The left ear sub-assembly 103*a* includes a left stem 104*a*, a left earcup 106*a*, and a left ear cushion 108*a*. Similarly, the right ear sub-assembly 103*b* includes a right stem 104*b*, a right earcup 106*b*, and a right ear cushion 108*b*.

In one or more embodiments, the head-worn audio device 100 comprises a set of over-the-ear (e.g., circumaural, etc.) headphones. In one or more embodiments, the head-worn audio device 100 comprises a set of on-the-ear (e.g., supraaural, etc.) headphones. Accordingly, each of the earcups 106 may house a speaker for generating audio signals that are perceptible to a user that is wearing the head-worn audio device 100. As an option, the head-worn audio device 100 may include one or more microphones for receiving the speech of the wearing user.

As shown in FIGS. 1A and 1B the headband 102 is a curved or arched band having the left ear sub-assembly 103*a* disposed at a first end of the headband 102 and the right ear sub-assembly 103*b* disposed at a second end of the headband 102. The headband 102 may be configured rest on top of the head of a user wearing the head-worn audio device 100, such that the head-worn audio device 100 is entirely supported by the user's head with the left ear sub-assembly 103*a* and right ear sub-assembly 103*b* pressed against the user's left and right ears, respectively; however it is understood that the floating-cup pivot disclosed herein may be suitable for other head-worn audio devices, such as those that are worn behind the head or neck. In one or more embodiments, the headband 102 may include a rigid metal or plastic member. Further, in one or more embodiments, cables traveling along and/or within the headband 102 may enable communication (e.g., audio signals, digital communications, etc.) between electronic and/or acoustic componentry housed in the different ear sub-assemblies 103.

Further still, each of the ear sub-assemblies 103 includes a stem 104 that protrudes through an aperture of a respective earcup 106. In particular, the left stem 104*a* is shown protruding through an aperture in the left earcup 106*a*, and the right stem 104*b* is shown protruding through an aperture in the right earcup 106*b*. As described below, each of the stems 104 is configured with a geometric profile that enables the corresponding earcup 106 to rotate freely relative to the stem 104, while preventing debris and electrostatic discharge from entering the earcup 106 without necessitating additional parts such as dust seals or covers.

As described herein, the ear cushions 108 may include any suitable interface between the earcups 106 and a wearing user's face. In one or more embodiments, the ear cushions 108 provide an acoustic seal that improves the listening experience of the user. As an option, the ear cushions 108 may include a foam (e.g., urethane foam, etc.) or gel material to ensure durability and resilience of the head-worn audio device 100, while providing comfort to the wearing user.

Figure 2B:
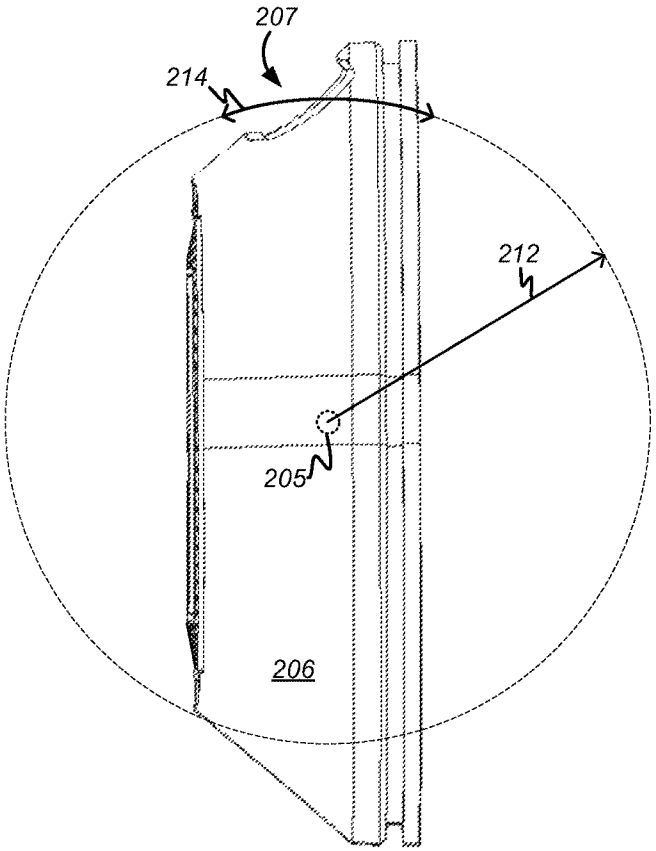
FIGS. 2A and 2B show an earcup, in accordance with one or more embodiments of the invention.
Figure 2A:
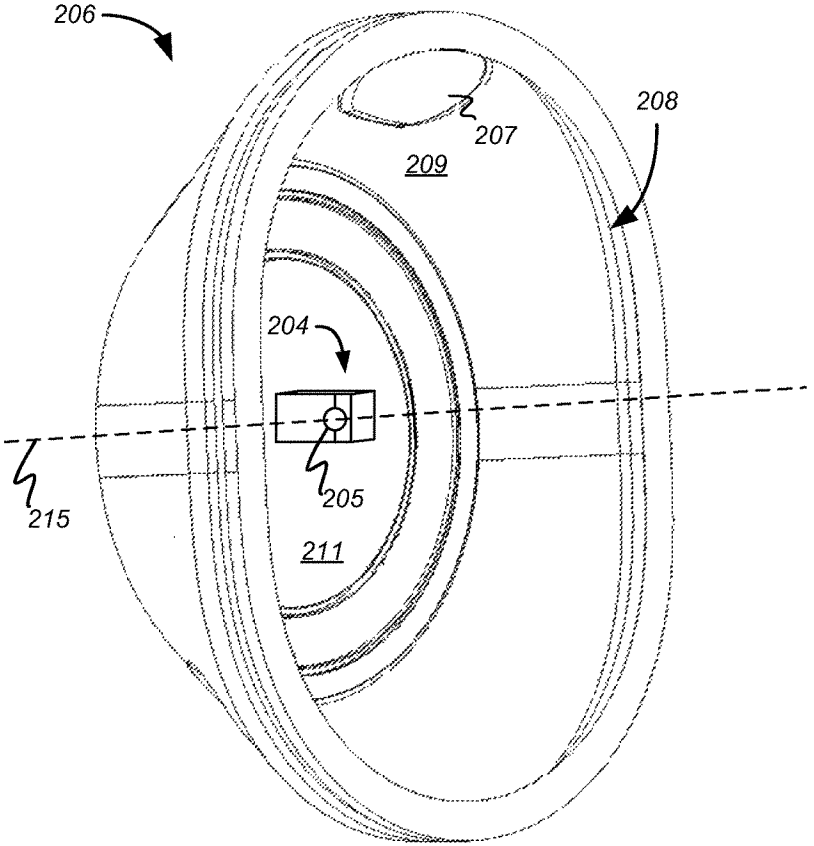

FIG. 2A shows a perspective view and FIG. 2B shows a front view of an earcup 206 for a head-worn audio device with a floating-cup pivot, according to one or more embodiments. Although the elements of the earcup 206 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 2A and 2B may be omitted, repeated, and/or substituted. Accordingly, various embodiments may lack one or more of the features shown. For this reason, embodiments of the invention should not be considered limited to the specific arrangements of elements shown in FIGS. 2A and 2B.

As illustrated in FIG. 2A, the earcup 206 is generally concave such that it defines an inner cavity 208. In one or more embodiments, the inner cavity 208 may house one or more electronic assemblies such as, for example, a digital-to-analog converter, a Bluetooth transceiver, and/or a battery. Furthermore, an aperture 207 is provided in a side wall 209 of the earcup 206. As described herein, the aperture 207 includes any opening in a wall of the earcup 206 through which a stem may pass as it travels along a bidirectional path that is defined, at least in part, by the position of a rotational axis 215, as described below. Although shown to be obround in FIG. 2A, the aperture 207 may be defined by any suitable shape, geometric or otherwise. For example, the aperture 207 may be generally round, rectangular, or triangular. Although the aperture 207 is described herein as being located within the side wall 209 of the earcup 206, it is understood that the aperture 207 may be located in any suitable place on the earcup 206. For example, in one or more embodiments, an aperture may instead be located within the back wall 211 of the earcup 206.

Still referring to FIGS. 2A and 2B, a pivot 205 is located within the inner cavity 208 of the earcup 206. In one or more embodiments, the pivot 205 includes a hinged or revolute joint that provides an arm attached to the pivot 205 with a single degree of movement. Thus, the pivot 205 defines a rotational axis 215, around which such an arm may rotate. In other words, in such embodiments, the rotational axis 215 of the pivot 205 may define a center of rotation for an arm that is attached to the pivot 205.

In one or more embodiments, the pivot 205 is physically coupled to the earcup 206. Thus, a position of the pivot 205 may be fixed within the inner cavity 208 of the earcup 206. The pivot 205 may be coupled with the earcup 206 in any suitable manner. For example, the pivot 205 may be physically coupled to the side wall 209 of the earcup 206 and/or may be physically coupled to the back wall 211 of the earcup 206. As shown in FIG. 2A, the pivot 205 is located within a stud 204 that is physically coupled to the back wall 211 of the earcup 206. In one or more embodiments, at least a portion of the stud 204 may be integrally formed with the back wall 211 or the side wall 209 such as, for example, during an injection molding process. In one or more embodiments, at least a portion of the stud 204 may be affixed to the back wall 211 of the earcup 206 and/or the side wall 209 of the earcup 206 by way of a discrete coupling step. For example, the stud 204 may be affixed to the earcup 206 by way of an adhesive, laser welding, or ultrasonic welding.

As illustrated in FIG. 2B, the location of the aperture 207 relative to the pivot 205 may define a path 214. In one or more embodiments, the path 214 lies along the circumference of a circle defined by a radius 212. The radius 212 is the distance between a location substantially central to the pivot 205 (i.e., the rotational axis 215) and a location substantially central to the aperture 207. As described herein, the path 214 includes any segment of the circumference of the circle, as defined by the radius 212, that passes through the aperture 207. In one or more embodiments, the radius 212 may be between 10-60 millimeters (mm) in length. For example, the radius 212 may be between 30-55 mm in length (e.g., 35 mm, 40 mm, 45 mm, etc.).

Figure 3:
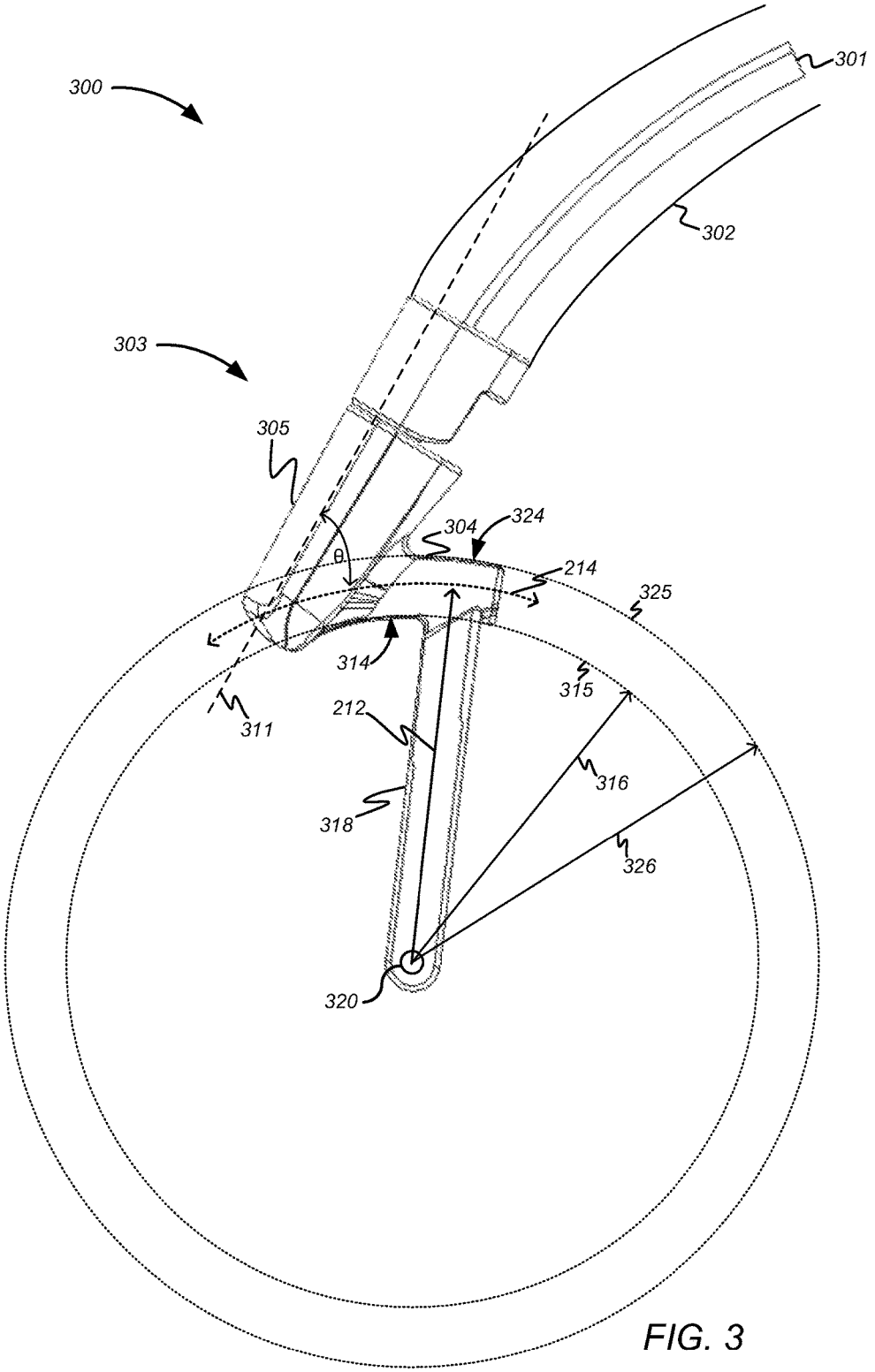
FIG. 3 shows a left ear or right ear sub-assembly with a single arm for a head-worn audio device with a floating-cup pivot, in accordance with one or more embodiments of the invention.

FIG. 3 shows a view of a head-worn audio device 300, according to one or more embodiments. Although the elements of the head-worn audio device 300 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIG. 3 may be omitted, repeated, and/or substituted. Accordingly, various embodiments may lack one or more of the features shown. For this reason, embodiments of the invention should not be considered limited to the specific arrangements of elements shown in FIG. 3.

As shown in FIG. 3, the head-worn audio device 300 includes a left ear or right ear sub-assembly 303. Also, the head-worn audio device 300 is shown to include a headband 302. For purposes of clarity, the left ear or right ear sub-assembly 303 is shown without an earcup. The left ear or right ear sub-assembly 303 includes a stem 304, an arm 318, and a headband slider 305 that is disposed at a terminus of a headband 302. The headband 302 houses a resilient band 301. As described herein, the headband slider 305 may include any component that interconnects the headband 302 with the stem 304. In one or more embodiments, the stem 304 may be directly interfaced with the headband 302, such that the headband slider 305 is not present.

In one or more embodiments, the headband slider 305 may encapsulate an end portion of the resilient band 301. Moreover, the headband slider 305 may be extended away from, and retracted towards, the headband 302 by a user in order to adjust the effective size of the head-worn audio device 300. As the headband slider 305 is extended and retracted, the resilient band 301 may slidably move within the headband 302. Moreover, as the headband slider 305 is extended and retracted, an earcup included in the sub-assembly 303 may articulate about a pivot relative to the stem 304. While the adjustment mechanism of the headband 300 is shown and described to include the resilient band 301 slidably housed within the headband 302, it is contemplated that any other suitable adjustment mechanism may be incorporated into a head-worn audio device that employs the floating-cup pivot described herein.

Still referring to FIG. 3, the stem 304 includes a curved member. In one or more embodiments, the curvature of the stem 304 corresponds, at least in part, to the radius 212, described above in reference to FIG. 2B. In one or more embodiments, the stem 304 extends from the headband slider 305 at an angle θ, which is between approximately 20-120 degrees relative to a longitudinal axis 311 of the headband slider 305. For example, the stem 304 may extend from the headband slider 305 at an angle θ of approximately 30-50 degrees relative to the longitudinal axis 311 of the headband slider 305. In embodiments without a headband slider 305, it is understood that the stem 304 may extend from the headband 302, or another component, at approximately the same angle. The curvature of the stem 304 may be substantially identical to an arc of the path 214, which is followed by the stem 304 as it rotates about a pivot (e.g., at a connector 320 coupled to the pivot 205, etc.) relative to an earcup.

The stem 304 includes an inner surface 314 and an outer surface 324. In one or more embodiments, the inner surface 314 and the outer surface 324 may be concentric about the same center point. For example, as illustrated in FIG. 3, the inner surface 314 of the stem 304 lies along an arc of a first circle 315, and the outer surface 324 of the stem 304 lies along an arc of a second circle 325. The first circle 315 is defined by a first radius 316, and the second circle 325 is defined by a second radius 326. The second radius 326 is greater than the first radius 316. The first circle 315 and the second circle 325 are both concentric about a center of the connector 320. The connector 320 may be rotatably attached to a pivot of an earcup, such that an axis of the connector 320 is coaxial with a rotational axis of the pivot, such as the rotational axis 215 described in reference to FIG. 2A. Accordingly, when the arm 318 is coupled to a pivot, both the inner surface 314 and the outer surface 324 of the stem 304 may be defined by segments of concentric circles that are centered on a single rotational axis.

In one or more embodiments, a cross-sectional profile of the stem 304 may be defined by any suitable shape, geometric or otherwise. For example, the cross-sectional profile of the stem 304 may be generally round, rectangular, or triangular. The cross-sectional profile of the stem 304 may be the same shape as a corresponding aperture in an earcup within which the stem 304 is installed, thereby minimizing any gap between the stem 304 and the earcup. Accordingly, the stem 304 may have a substantially obround cross-sectional profile for passing within the aperture 207 of the earcup 206, described in reference to FIGS. 2A and 2B.

In one or more embodiments, the arm 318 extends from the stem 304 in a direction generally away from the headband 302. In one or more embodiments, the arm 318 extends from the stem 304 in a direction that is generally orthogonal to the curvature of the stem 304, and toward a center of a circle that path 214 lies upon. In other words, the arm 318 may extend from the inner surface 314 of the stem to a center of the circle 315. The arm 318 may be configured having the stem 304 disposed at a first end of the arm 318, and a connector 320 disposed at a second end of the arm 318. The connector 320 may be rotatably attached to a pivot that is fixedly positioned within a cavity of an earcup. Accordingly, the connector 320 is configured to enable the rotatable attachment of the arm 318 to a pivot of an earcup, such as the pivot 205 of the earcup 206, described in reference to FIGS. 2A and 2B. In one or more embodiments, the connector 320 includes a hole, pin, hinge, bushing, and/or bearing. In one or more embodiments, the arm 318 and the stem 304 may be formed as a single integral part, such as a single plastic part manufactured in an injection molding process. However, in other embodiments, the arm 318 and the stem 304 may be manufactured separately, and subsequently joined using, for example, an adhesive, laser welding, or ultrasonic welding.

As shown in FIG. 3, the arm 318 is a generally linear shaft of approximately the same length as the radius 212. It is contemplated, however, that in one or more embodiments the arm may be kinked or bent in a direction into the page, out of the page, and/or in the plane of the page. In one or more embodiments, the arm 318 is generally rigid, and inflexibly attached to the stem 304.

Figure 4B:
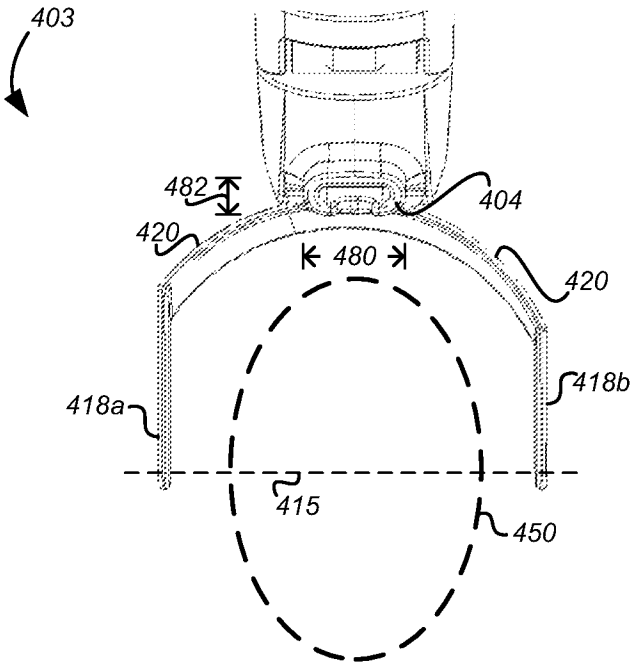
FIGS. 4A and 4B show a left ear or right ear sub-assembly of a head-worn audio device with floating-cup pivots, in accordance with one or more embodiments of the invention.
Figure 4A:
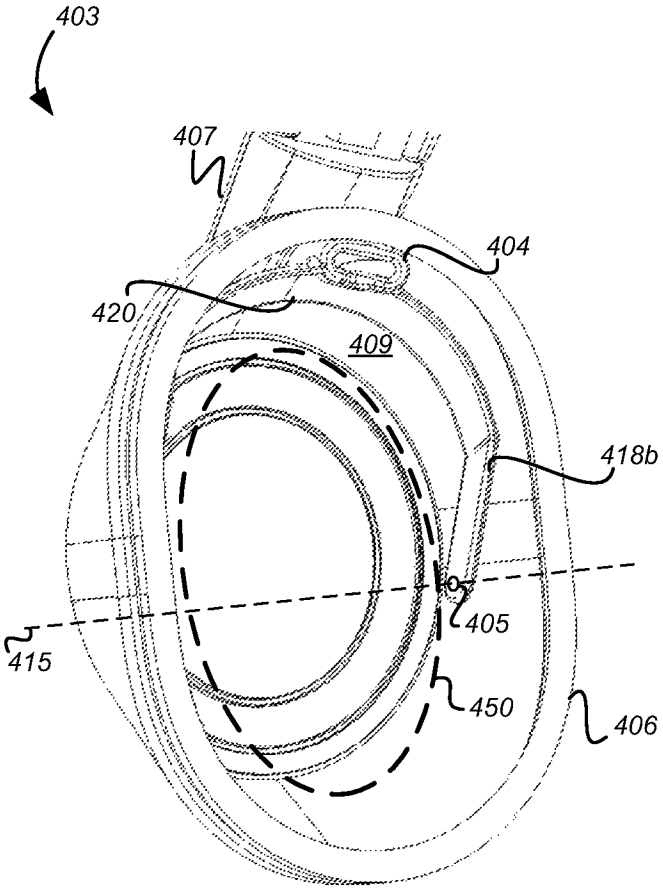

FIG. 4A shows a perspective view of a left ear or right ear sub-assembly 403 of a head-worn audio device with a floating-cup pivot, according to one or more embodiments. FIG. 4B shows a side view of the left ear or right ear sub-assembly 403, with the earcup 406 hidden for clarity. Although the elements of the left ear or right ear sub-assembly 403 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 4A and 4B may be omitted, repeated, and/or substituted. Accordingly, various embodiments may lack one or more of the features shown. For this reason, embodiments of the invention should not be considered limited to the specific arrangements of elements shown in FIGS. 4A and 4B.

As shown in FIGS. 4A and 4B, a stem 404 extends from a headband slider 407, through an aperture of an earcup 406, and into a cavity of the earcup 406. As the stem 404 extends from the headband slider 407, it curves along a circular arc. Any movement of the stem 404, relative to the earcup 406 and about a rotational axis 415, also occurs along this arc, which is herein referred to as the path of the stem 404. The stem 404 may include an inner surface and an outer surface, which are generally concentric about the same center point. As an option, the center point may include the rotational axis 415. The rotational axis 415 is defined, at least in part, by two pivots within a cavity of the earcup 406.

Specifically, the rotational axis 415 is defined by a first pivot to which an end of a first arm 418*a* is attached, and a second pivot to which an end of a second arm 418*b* is attached. More specifically, the first arm 418*a* is rotatably attached to a first pivot (which is occluded from view in FIG. 4A) fixed within the earcup 406, and the second arm 418*b* is rotatably attached to a second pivot 405 fixed within the earcup 406. Each of the first pivot and second pivot 405 include a hinged or revolute joint that provides the arm 418 attached to the first pivot or second pivot 405, respectively, with a single degree of movement. As shown in FIGS. 4A and 4B, the first pivot and the second pivot 405 together define the rotational axis 415, around which both the first arm 418*a* and the second arm 418*b* may rotate. In other words, the rotational axis 415 of the first pivot and the second pivot 405 establishes a center of rotation for the arms 418 that are attached thereto, as well as the stem 404.

In one or more embodiments, the stem 404 may have relatively uniform exterior dimensions in the two directions orthogonal to its curvature. In other words, the stem 404 may have relatively uniform exterior dimensions in the two directions orthogonal to the path of the stem 404. For example, as shown in FIG. 4B, the stem 404 is characterized by a uniform first exterior dimension 480 (i.e., width), as well as a uniform second exterior dimension 482 (i.e., height).

As shown in FIGS. 4A and 4B, the first arm 418*a* and the second arm 418*b* are both connected to the stem 404 via a yoke 420. In other words, the yoke 420 is coupled to both an end of the first arm 418*a* and an end of the second arm 418*b*. The yoke 420 extends from the stem 404 within the cavity of the earcup 406. In one or more embodiments, at least a portion of the yoke 420 may be curved such that it extends in a manner substantially parallel to a side wall 409 of the earcup 406. Embodiments using multiple arms 418 joined by a yoke 420 may provide for a floating-cup pivot with greater torsional rigidity than the single-arm embodiments disclosed above (e.g., FIG. 3, etc.).

As described herein, the yoke 420 is relatively rigid and interconnects the arms 418 such that one of the arms 418 may not rotate about the rotational axis 415 relative to the earcup 406 without the other of the arms 418 also rotating in the same manner. In one or more embodiments, the yoke 420 may extend from an inner surface of the stem 404 towards the rotational axis 415. Similarly, the arms 418 may extend from the yoke 420 towards the rotational axis 415. Thus, both the yoke 420 and the arms 418 may extend in a direction that is generally orthogonal to the curvature of the stem 404. As an option, the first arm 418*a* and the second arm 418*b* may be co-planar.

In one or more embodiments, the stem 404, the yoke 420, and the arms 418 may be formed as a single integral part. For example, the stem 404, the yoke 420, and arms 418 may be a single plastic part manufactured in an injection molding process. In one or more embodiments, any of the stem 404, the arms 418, and the yoke 420 may be manufactured separately, and subsequently joined using, for example, an adhesive, laser welding, or ultrasonic welding.

With any rotation relative to the earcup 406 and about the rotational axis 415, the yoke 420 and arms 418 may travel substantially proximate to and parallel with the side wall 409 of the earcup 406. Consequently, the cavity of the earcup 406 is configured to include a space 450. In one or more embodiments, one or more electronic assemblies may be installed within the space 450, between the arms 418. In such embodiments, the yoke 420 and arms 418 may rotate freely within the cavity of the earcup 406 without impediment due to such electronic assemblies.

Figure 5A:
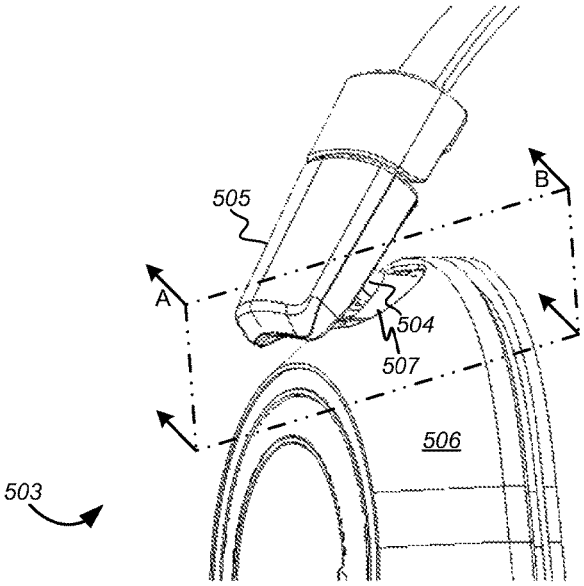
FIGS. 5A and 5B show a left ear or right ear sub-assembly of a head-worn audio device with floating-cup pivots, in accordance with one or more embodiments of the invention.
Figure 5B:
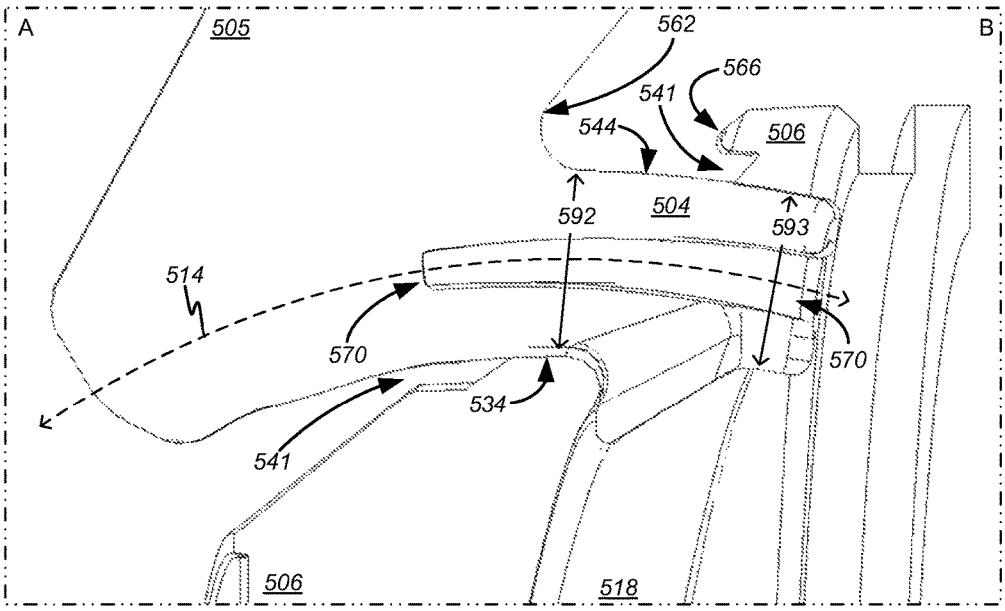

FIG. 5A shows a perspective view of a left ear or right ear sub-assembly 503 of a head-worn audio device with a floating-cup pivot, according to one or more embodiments. FIG. 5B shows a front or back view of the left ear or right ear sub-assembly 503, as defined by the cross-section AB of FIG. 5A. Although the elements of the left ear or right ear sub-assembly 503 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 5A and 5B may be omitted, repeated, and/or substituted. Accordingly, various embodiments may lack one or more of the features shown. For this reason, embodiments of the invention should not be considered limited to the specific arrangements of elements shown in FIGS. 5A and 5B.

As shown in FIGS. 5A and 5B, a stem 504 extends from a headband slider 505, through an aperture 507 of an earcup 506, and into a cavity of the earcup 506. As the stem 504 extends through the aperture 507, the stem 504 curves, at least in part, along an arc that is substantially identical to a path 514. Furthermore, an arm 518 is shown attached to the stem 504, and extending downward towards a pivot that is fixedly mounted within a cavity of the earcup 506. The pivot defines a rotational axis of the arm 518. Accordingly, the path 514 includes numerous points that are equidistant from the rotational axis of the arm 518. In this way, the arc of the stem 504 may be substantially the same as the path 514 followed by the stem 504 as it rotates, relative to the earcup 506, around one or more pivots within the earcup 506.

As shown in FIG. 5B, the stem 504 includes an inner surface 534 and an outer surface 544. In one or more embodiments, the inner surface 534 lies along a first arc of a first circle having a first radius, and the outer surface 544 lies along a second arc of a second circle having a second radius, where the second radius is larger than the first radius. The first circle and the second circle may be concentric around the same center point. Moreover, the center point of the two circles may comprise a rotational axis, where the rotational axis is defined by one or more pivots within the earcup 506. In this way, the inner surface 534 and outer surface 544 may both be generally concentric around the same pivot(s), about which the stem may rotate relative to the earcup 506.

In one or more embodiments, the arm 518 may be directly attached to the stem 504, as described above in reference to the arm 318 and the stem 304 of FIG. 3. In other words, the left ear or right ear sub-assembly 503 depicted in FIGS. 5A and 5B may include only a single arm 518 and a single corresponding pivot. In other embodiments, the arm 518 may be attached to the stem 504 by way of a yoke, such that two arms extend from the yoke and are each rotatably attached to a respective pivot that is fixedly mounted within the earcup 506, as described above in reference to FIGS. 4A and 4B.

In one or more embodiments, a gap 541 may exist between the stem 504 and the edges of the earcup 506. A size of the gap 541 may be substantially constant around an outside surface of the stem 504. As an option, the gap 541 between the stem 504 and the earcup 506 may be consistently between 0.1-3 mm around the entirety of the stem 504. For example, the gap 541 between the stem 504 and the earcup 506 may be consistently about 0.5 mm around the entirety of the stem 504, about 1 mm around the entirety of the stem 504, about 2 mm around the entirety of the stem 504, etc. In other words, if the gap 541 between the inner surface 534 of the stem 504 and the earcup 506 is approximately 1 mm, then the gap 541 between the outer surface 544 of the stem 504 and the earcup 506 may also be approximately 1 mm. Thus, the aperture 507 may have only a slightly larger offset (e.g., 0.1 mm, 0.3 mm, 0.5 mm, 1 mm, 1.5 mm, 2 mm, 4 mm, etc.) than the exterior dimensions of the stem 504.

For at least some distance along the path 514, the stem 504 may have relatively uniform exterior dimensions in one or both directions orthogonal to the path 514. For example, the stem 504 may have a uniform first exterior dimension in a direction into the page of FIG. 5B and along some segment of the path 514; and/or a uniform second exterior dimension in a direction that is defined by a radius of the path 514 and along some segment of the path 514. For example, a height of the stem 504 at a first cross-section 592 may be within 0-2 mm of a height of the stem 504 at a second cross-section 593. Similarly, a depth of the stem 504 at the first cross-section 592 may be within 0-2 mm of a depth of the stem 504 at the second cross-section 593.

Thus, as the stem 504 moves, relative to the earcup 506, in either direction along the path 514, the gap 541 between the stem 504 and the earcup 506 may remain substantially consistent. For example, with reference the FIG. 5B, the stem 504 may move, relative to the earcup 506, along the path 514 towards the cavity of the earcup 506 until an outer surface 562 of the headband slider 505 contacts an outer surface 566 of the earcup 506. Throughout the entire articulation of the stem 504 relative to the earcup 506, any opening between the stem 504 and the earcup 506 may be characterized as having substantially the same dimensions (e.g., within 0.1 mm, within 0.5 mm, etc.) as the gap 541 shown in FIG. 5B.

Accordingly, in one or more embodiments, the gap 541 may be minimized to prevent the entry of debris from the surrounding environment into the earcup 506. Moreover, because of the uniformity of the gap 541, regardless of the angle of the earcup 506 relative to the stem 504 (i.e., as it travels along the path 514), there is no need for a dust seal or other discrete element to be installed in cooperation with the gap 541.

In one or more embodiments, the stem 504 may be configured to have a length sufficient to allow the earcup 506 to rotate, relative to the stem 504, between 5-30 degrees. For example, the stem 504 may be configured to have a length that provides the earcup 506 with approximately 12 degrees of articulation. Accordingly, the length of the stem 504 may depend upon the distance of the stem 504 from its rotational axis or pivot(s). In other words, the length of the stem 504 may depend on the length of the arm(s) 518, and, as an option, the length of a yoke to which the arm(s) 518 are attached. By way of a more specific example, if the stem 504 is located approximately 40 mm from its rotational axis, and provides the earcup 506 with at least 12 degrees of articulation, then the stem 504 must be at least approximately 8.5 mm in length. As an option, this requirement may be met by ensuring that the outer surface 544 of the stem 504 is at least approximately 8.5 mm long, and the inner surface 534 of the stem 504 is also at least approximately 8.5 mm long. To accommodate the somewhat frustoconical conformation of the earcup 506, the inner surface 534 may be offset some distance along the path 514 relative to the outer surface 544. In other words, the inner surface 534 and the outer surface 544 may not be centered relative to each other.

In one or more embodiments, the stem 504 may include a channel 570. As described herein, the channel 570 includes a hollow passage within the stem 504 that extends from outside of the earcup 506 to the cavity of the earcup 506. For example, as depicted in FIG. 5B, the channel 570 extends from the headband slider 505, and along the length of the stem 504 into the earcup 506. In one or more embodiments, the channel 570 may be used, at least in part, to communicatively couple a right ear sub-assembly 503 with a left ear sub-assembly 503. For example, one or more cables passing current, analog signals, and/or digital communications may extend from the right ear sub-assembly 503 to the left ear sub-assembly 503, for passing power, signals, and/or communications therebetween.

Described hereinabove are various embodiments of a floating-cup pivot for head-worn audio devices, such as a headphones and headsets. The floating-cup pivot is configured to allow articulation of the earcups of such head-worn audio devices, while maintaining a static and minimally sized exterior gap on the earcups. Thus, the floating-cup pivot described herein may prevent the passage of harmful elements to the inner cavity of the earcups, thereby ensuring that electronic components housed within such earcups are not harmed by debris and electrostatic discharge, without requiring installation of a discrete barrier, such as a dust seal.

A number of implementations have been described. Nevertheless, various modifications may be made without departing from the scope of the disclosure. Accordingly, other implementations are within the scope of the following claims.

What is claimed is:

1. A head-worn audio device, comprising:

an earcup defining an inner cavity, wherein a wall of the earcup includes an aperture;

a first pivot within the inner cavity of the earcup, the first pivot defining a rotational axis;

a second pivot within the inner cavity of the earcup;

a first arm having a first end and a second end, wherein the first end of the first arm is rotatably attached to the first pivot;

a second arm having a third end and a fourth end, wherein the third end of the second arm is rotatably attached to the second pivot;

a stem disposed toward the second end of the first arm, wherein the stem is configured to rotate along a path passing through the aperture of the earcup; and a yoke coupled to the second end of the first arm and the fourth end of the second arm, the yoke connecting the first arm, the second arm, and the stem.

2. The head-worn audio device of claim 1, wherein the aperture is defined within a side wall of the earcup.

3. The head-worn audio device of claim 1, wherein the first pivot is physically coupled to the earcup, such that a position of the first pivot is fixed within the inner cavity of the earcup.

4. The head-worn audio device of claim 1, wherein the first pivot and the second pivot define the rotational axis.

5. The head-worn audio device of claim 4, wherein the first arm is co-planar with the second arm.

6. A head-worn audio device, comprising:

an earcup defining an inner cavity, wherein a wall of the earcup includes an aperture;

a first pivot within the inner cavity of the earcup, the first pivot defining a rotational axis;

a first arm having a first end and a second end, wherein the first end of the first arm is rotatably attached to the first pivot; and a stem disposed toward the second end of the first arm, wherein the stem is configured to rotate along a path passing through the aperture of the earcup;

wherein the stem includes an inner surface and an outer surface;

wherein the inner surface of the stem lies along a first arc of a first circle concentric about the rotational axis.

7. The head-worn audio device of claim 6, wherein the outer surface of the stem lies along a second arc of a second circle concentric about the rotational axis.

8. The head-worn audio device of claim 7, wherein the first circle is defined by a first radius, and the second circle is defined by a second radius that is greater than the first radius of the first circle.

9. The head-worn audio device of claim 8, wherein a gap between the stem and the earcup, as the stem rotates relative to the earcup about the rotational axis, is substantially constant around an outside surface of the stem.

10. The head-worn audio device of claim 9, wherein the aperture includes an obround aperture.

11. The head-worn audio device of claim 10, wherein the stem is defined by an obround cross-sectional profile.

12. The head-worn audio device of claim 1, wherein the stem includes a channel.

13. The head-worn audio device of claim 12, wherein the channel comprises a hollow passage within the stem that extends from outside of the earcup to the inner cavity of the earcup.

14. A head-worn audio device, comprising:

an earcup defining an inner cavity, wherein a wall of the earcup includes an aperture;

a first pivot fixedly mounted within the inner cavity of the earcup;

a second pivot fixedly mounted within the inner cavity of the earcup, wherein the first pivot and the second pivot define a rotational axis;

a first arm within the inner cavity of the earcup, the first arm having a first end and a second end, wherein the first end of the first arm is rotatably attached to the first pivot;

a second arm within the inner cavity of the earcup, the second arm having a third end and a fourth end, wherein the third end of the second arm is rotatably attached to the second pivot;

a yoke, wherein the yoke is coupled to the second end of the first arm and the fourth end of the second arm; and a stem extending from outside of the earcup and through the aperture of the earcup to the inner cavity of the earcup, wherein the stem is coupled to the yoke and rotates about the rotational axis.

15. The head-worn audio device of claim 14, wherein the stem includes an inner surface and an outer surface.

16. The head-worn audio device of claim 15, wherein the inner surface of the stem lies along a first arc of a first circle concentric about the rotational axis.

17. The head-worn audio device of claim 16, wherein the outer surface of the stem lies along a second arc of a second circle concentric about the rotational axis.

18. The head-worn audio device of claim 17, wherein the second circle is defined by a second radius that is greater than a first radius of the first circle.

* * * * *